US007566823B1

(12) United States Patent
Niskanen

(10) Patent No.: US 7,566,823 B1
(45) Date of Patent: Jul. 28, 2009

(54) BRIDGE SYSTEM FOR ACOUSTIC GUITARS

(75) Inventor: Clarence E. Niskanen, 1700 NW. 199th St., Shoreline, WA (US) 98177

(73) Assignee: Clarence E. Niskanen, Shoreline, WA (US)

( * ) Notice: Subject to any disclaimer, the term of this patent is extended or adjusted under 35 U.S.C. 154(b) by 0 days.

(21) Appl. No.: 11/499,206

(22) Filed: Aug. 4, 2006

Related U.S. Application Data

(60) Provisional application No. 60/737,883, filed on Nov. 18, 2005, provisional application No. 60/714,493, filed on Sep. 6, 2005.

(51) Int. Cl.
*G10D 3/14* (2006.01)

(52) U.S. Cl. ..... 84/313; 84/312 R; 84/307

(58) Field of Classification Search ..... 84/313, 84/312 R, 307–311
See application file for complete search history.

(56) References Cited

U.S. PATENT DOCUMENTS

| | | | | | |
|---|---|---|---|---|---|
| 3,896,695 | A * | 7/1975 | Kingsbury | ..... | 84/307 |
| 4,807,508 | A | 2/1989 | Yairi | | |
| 4,840,103 | A * | 6/1989 | Mayer | ..... | 84/297 R |
| 5,305,675 | A * | 4/1994 | Lasner | ..... | 84/313 |
| 5,515,761 | A * | 5/1996 | Sides | ..... | 84/313 |
| 5,661,252 | A | 8/1997 | Krawczak | | |
| 5,969,279 | A | 10/1999 | Dickson | | |

* cited by examiner

*Primary Examiner*—Kimberly R Lockett

(57) ABSTRACT

A bridge system for acoustic guitars which utilizes a string anchor rigidly attached to the under-side of the bridge plate, with provisions in the bridge, soundboard, and bridge plate to allow the guitar strings to pass from the bridge saddle to the string anchor untouched. The attachment of the guitar strings to the string anchor is also rigid. These features assure increased efficiency at which the string vibratory energy is utilized to vibrate the guitar soundboard, and also that the attenuation problems of current guitar bridge configurations are diminished.

6 Claims, 1 Drawing Sheet

BRIDGE SYSTEM FOR ACOUSTIC GUITARS

RELATED APPLICATIONS

The present application is a continuation-in-part application of U.S. provisional patent application Ser. No. 60/737,883, filed Nov. 18, 2005, included by reference herein and for which benefit of the priority date is hereby claimed.

The present application is a continuation-in-part application of U.S. provisional patent application Ser. No. 60/714,493, filed Sep. 6, 2005, included by reference herein and for which benefit of the priority date is hereby claimed.

The present application is a continuation-in-part application of United States patent application, Ser. No. Disclosure Document 578134, filed May 23, 2005, included by reference herein and for which benefit of the priority date is hereby claimed.

FIELD OF THE INVENTION

The present invention relates to bridge systems for acoustic guitars, and, more particularly, to bridge systems to correct the string attenuation problems of current acoustic guitars, thereby increasing volume and sustain, and improving the tonal qualities.

BACKGROUND OF THE INVENTION

Practically, ever since acoustic guitars have been manufactured, the method used to anchor the guitar strings to the guitar body have been by means of tapered pins which are installed, along with the guitar strings, into tapered holes through the bridge, soundboard, and bridge plate. The tapered pins entrap the ball-ends of the guitar strings to the under-side of the bridge plate. The problem with this method is that the guitar strings from the bridge saddle to the string anchor points contact wood at high forces, which causes the wood to deform. And since the entire guitar string encounters variable tension in unison with the string vibration, any contact of the guitar string or guitar string ball-end with wood will attenuate the string vibration with resultant loss of sustain, volume, and tonal quality.

The following U.S. Patents attempt to rectify the attenuation problems with acoustic guitar strings:

U.S. Pat. No. 4,202,240, Gerald Dickson, Oct. 19, 1999

U.S. Pat. No. 4,807,508, Yairi Kazno, Nov. 17, 1987

U.S. Pat. No. 5,661,252, Kazimere Marian Krawczak, Aug. 8, 26, 1997

U.S. Pat. No. 4,202,240 utilizes a cantilevered bridge pin which offers a compliant anchor point, and would cause rapid attenuation of the guitar string vibration.

U.S. Pat. No. 4,807,508 does provide the guitar strings clear passage from the saddle to the string anchor point. However, the anchor is wood with tapered pins which is a much more compliant method than used in my invention.

U.S. Pat. No. 5,661,252 has some good points, such as a clear passage for the guitar strings from saddle to anchor, and a non-compliant material for the anchor. However, the anchor is a cantilevered beam which would bend as a result of the guitar string force of approximately 180 pounds. This would result in rapid decay of the string vibration, and almost the total loss of guitar string ball-end energy which is reacted into the guitar neck attachment structure rather than the soundboard.

It is therefore an object of the invention to provide an efficient method of transmitting guitar string vibratory energy into the guitar soundboard.

It is another object of the invention to provide a method of reducing the string attenuation problems of current guitars.

SUMMARY OF THE INVENTION

In accordance with the present invention, there is provided a bridge system for acoustic guitars which utilizes a string anchor rigidly attached to the under-side of the bridge plate, which is rigidly attached to the soundboard. Thus there is minimal relative movement between the anchor and the soundboard. This is important for two reasons. One is that any compliance in the anchor point, other than that which is required to excite the soundboard, increases the guitar string attenuation. The second reason is that the guitar string ball-end, which attaches to the anchor, is a very important component of the vibratory energy of the guitar string. This is because the vibration of the guitar string causes a variable tension in the guitar string which is in unison with the vibration, thus the string ball-end variable tension is reacted by the anchor, which works in conjunction with the guitar bridge to excite the guitar soundboard. This improves the sound quality by increasing the utilization of subtle overtones of the string vibration, and also increases the volume and sustain of the guitar sound. The bridge, saddle, guitar top, and bridge plate are conventional except that the guitar strings are allowed clear passage from the saddle to the string anchor. This is achieved by string clearance holes through the guitar top, bridge plate, and bridge.

BRIEF DESCRIPTION OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the Figures.

DESCRIPTION OF THE PREFERRED EMBODIMENT

Figure 1:
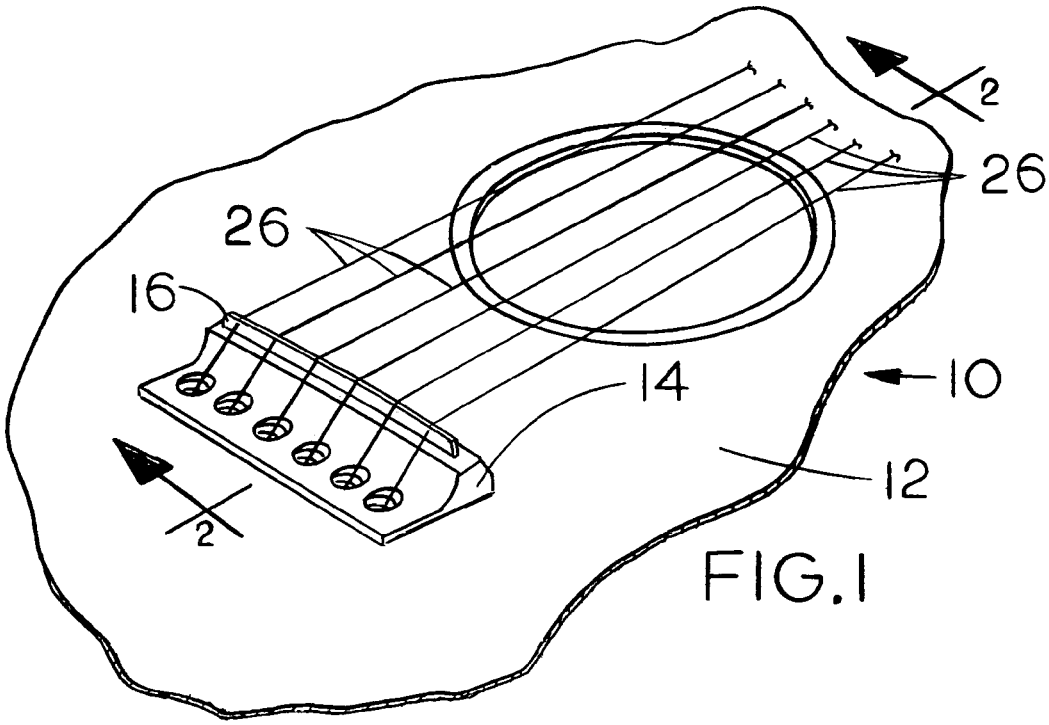
FIG. 1 is a top perspective view of a bridge system for acoustic guitars in accordance with the invention.
Figure 2:
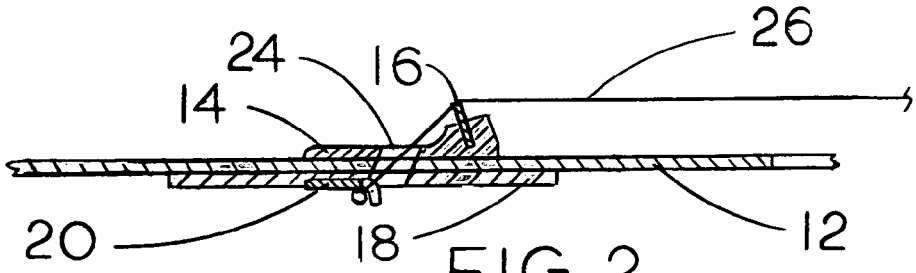
FIG. 2 is a top sectional view of a bridge system in accordance with the invention.

FIG. 1 is a top perspective view of a bridge system 10 for acoustic guitars in accordance with the invention. FIG. 1 and FIG. 2 show the general configuration of the bridge 14. The bridge 14 may be fabricated of ebony, rosewood, or any other suitable material, and is made as light as possible to minimize the loss of string vibratory energy required to excite bridge 14. Use hide glue or any suitable adhesive to bond the bridge 14 to soundboard 12. Alternatives to the preferred embodiment bridge 14 is a bridge 14 without a saddle 16, and a bridge 14 of a predetermined size and configuration to allow each guitar string 26 to bypass the bridge 14 precluding the requirement for hole 24 through bridge 14.

FIG. 2 is a top sectional view of a bridge system 10 for acoustic guitars in accordance with the invention. Shown is the relativity of the elements, and also shown is the free passage for each guitar string 26 from saddle 16 to anchor 20, provided by a hole 24 through bridge 14, soundboard 12, and bridge plate 18. This freedom assures minimum attenuation of each guitar string 26.

Figure 3:
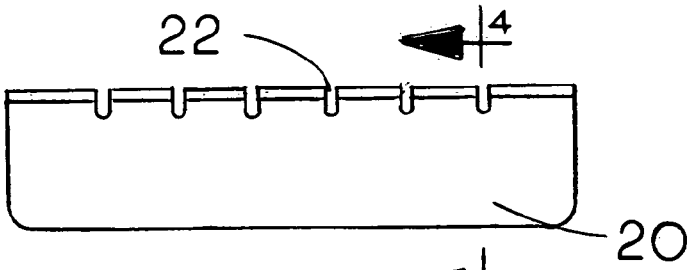
FIG. 3 is a detail view of a string anchor in accordance with the invention.

FIG. 3 is a detail view of an anchor 20 in accordance with the invention. The anchor 20 may be constructed of metal, or any other suitable material. The thickness of the anchor 20 is dependent on the material, and will be predetermined according to the stiffness and strength of the material. The slot 22, one for each guitar string 26, entraps the ball-end of the guitar string 26. The anchor 20 is embedded into the bridge plate 18 to approximately 0.12 inches, and bonded with hide glue or any other suitable adhesive. The position of the anchor 20 relative to the saddle 16 is such that the break angle of each guitar string over the saddle 16 is approximately 40 degrees. Multiple alternative embodiments to the preferred embodiment are possible. Any method of anchoring the ball end of each guitar string 26 rigidly to the back-side of the bridge plate 18 or soundboard 12, and also facilitating the removal and installation of guitar strings is within the scope of my invention.

Figure 4:
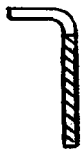
FIG. 4 is a right sectional view of a string anchor in accordance with the invention.

FIG. 4 is right sectional view of the string anchor 20.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. An bridge system for an acoustic guitar having a soundboard with a reinforcing means on the undersurface of said soundboard, to transmit vibratory energy from a plurality of guitar strings onto said soundboard, the said plurality of guitar strings having a restraining means, comprising:

a bridge, including a string support saddle mounted therein, for supporting said plurality of guitar strings at a predetermined string break-angle at a predetermined location and distance from the uppersurface of said soundboard, rigidly attached thereupon, an anchor of rigid material for securely attaching said plurality of guitar strings at said predetermined string break-angle at a predetermined location and distance from the undersurface of said reinforcing means on the undersurface of said soundboard, rigidly attached therein, means to enable untouched passage for said plurality of guitar strings from the said string break-angle location on the bridge saddle to said anchor on a vector congruent to said predetermined string break-angle.

2. The bridge system of claim 1 wherein means for enabling untouched passage for said plurality of guitar strings from said string break-angle location on said bridge saddle to said anchor is by a hole or a plurality of holes through the protrusive portion of said bridge on said vector congruent to said predetermined string break-angle.

3. The bridge of claim 1 whereby providing means to enable untouched passage for said plurality of guitar strings from said string break-angle on said bridge saddle to said anchor comprises reducing the protrusive portion of said bridge to allow the strings to bypass said bridge.

4. The bridge system of claim 1 wherein means for enabling untouched passage for said plurality of guitar strings from said predetermined string break-angle on said bridge saddle to said anchor is provided by a hole or a plurality of holes through said soundboard and the soundboard reinforcing on a vector congruent to said predetermined string break-angle.

5. The bridge system of claim 1 wherein said anchor is made from sheet metal of predetermined thickness and size and has a number of slots equal to the said plurality of the guitar strings, with the width of said slots allowing the insertion of said guitar strings, but not allowing said restraining means of said guitar strings, which are larger than the string diameters, to pass through said slots, thereby entrapping said plurality of guitar strings.

6. The anchor of claim 5 further comprising a break-form flange of predetermined size and angle on the slotted side of said anchor, with the break-form radius of approximately 0.08 inches, with the length of the flange approximately 0.25 inches less than the length of said slots.

* * * * *